United States Patent [19]

Rhodes

[11] 4,358,866

[45] Nov. 16, 1982

[54] AMPHIBIOUS FURNITURE

[76] Inventor: Roger D. Rhodes, 6125 E. Indian School Rd. #268, Scottsdale, Ariz. 85251

[21] Appl. No.: 88,038

[22] Filed: Oct. 25, 1979

[51] Int. Cl.[3] ..... B63C 9/08

[52] U.S. Cl. ..... 114/363; 297/157; 441/73; 441/35

[58] Field of Search ..... 9/11 R, 11 A, 347, 7, 9/310 C; 114/264, 266, 267; 297/157, 170, 463, 247, 174, 440, 159

[56] References Cited

U.S. PATENT DOCUMENTS

| | | | |
|---|---|---|---|
| 1,555,589 | 9/1925 | LaFarina | 9/11 R |
| 1,908,420 | 5/1933 | Harris | 9/11 R |
| 2,332,009 | 10/1943 | Perri | 9/11 R |
| 2,510,199 | 6/1950 | Schladermundt | 297/247 |
| 2,674,753 | 4/1954 | Wood | 9/11 A |
| 2,983,308 | 5/1961 | Horowitz | 297/159 |
| 3,117,327 | 1/1964 | Mathew | 9/347 |
| 3,154,345 | 10/1964 | Lambrecht | 9/11 R |
| 3,160,437 | 12/1964 | Hill | 297/174 |
| 3,363,361 | 1/1968 | Helfer | 297/440 |
| 3,984,888 | 10/1976 | DeLano | 9/347 |

FOREIGN PATENT DOCUMENTS

| | | | |
|---|---|---|---|
| 41853 | 12/1969 | Finland | 297/157 |
| 415549 | 8/1935 | United Kingdom | 297/157 |

*Primary Examiner*—Trygve M. Blix
*Assistant Examiner*—D. W. Keen
*Attorney, Agent, or Firm*—Don J. Flickinger

[57] ABSTRACT

A kit includes a legless table and a chair having a tubular frame with detachable legs. The table is detachably connectable to the chair. Rigid flotation material encases portions of the tubular frame and buoyantly supports the chair and the table.

6 Claims, 6 Drawing Figures

AMPHIBIOUS FURNITURE

This invention relates to furniture.

In a further aspect, the present invention relates to chairs and tables especially adapted for outdoor use.

More particularly, the instant invention concerns a kit for variably erectable amphibious furniture.

Swimming pools are exceedingly popular centers of recreational activity. Many private homes, apartment complexes, motels and hotels feature swimming pools. In addition to swimming and playing in the water, the residents, tenants and guests sunbathe upon the surrounding deck.

In order to enhance the enjoyment of persons utilizing swimming pools, the prior art has contrived various apparatus. These devices include numerous deck oriented structures commonly referred to as patio furniture. Included are chairs, tables, lounges and umbrellas. Floats, games, toys and other water oriented items are also abundant.

The development of multi-use apparatus, amphibious items useable both upon the deck and in the water, has been largely neglected. The relatively few products available are generally limited to articles of the type characterized by floating cushions or mattresses. Even here, the development has not centered around swimming pool accessories but rather safety equipment especially adapted for use in vehicles such as boats and airplanes.

A search was conducted within records of the United States Patent and Trademark Office to determine prior art references relevant to the instant invention. The search revealed the following issued United States Patents:

U.S. Pat. No. 1,908,420 Harris et al
U.S. Pat. No. 3,160,437 Hill
U.S. Pat. No. 1,555,589 La Farina
U.S. Pat. No. 2,332,009 Perri
U.S. Pat. No. 2,674,753 Wood
U.S. Pat. No. 3,363,361 Helfer
U.S. Pat. No. 2,983,308 Horowitz
U.S. Pat. No. 3,154,345 Lambrecht
U.S. Pat. No. 2,510,199 Schladermundt U.S. Pat. No. 1,555,589 discloses a float having a U-shaped inflatable tube to which is attached a frame. A seat and back, formed of slats, are carried by the frame.

U.S. Pat. No. 1,908,420 discloses a float having a rectangular central buoyant portion with a pair of end pieces extending along two opposite ends thereof. A pair of side rods, one spaced from each side of the central portion, are supported by respective ends of the pair of end pieces.

U.S. Pat. No. 2,332,009 discloses a float having a hinged collapsible frame secured between a pair of inflatable pontoons. A seat extends between the spaced side rails of the frame.

U.S. Pat. No. 2,510,199 discloses a combination table and bench structure and teeter-totter including a frame having two laterally extending side rails. A pair of rockers, one secured at the mid point of each side rail, support a table top. At each end of the frame is a seat having a back which may be swung downwardly for use as a leg to prevent rocking of the device.

U.S. Pat. No. 2,674,753 discloses a boat including an aft section and a fore section joined in space relation by a pair of spaced apart stringers. Inflatable circular occupant supporting member is insertable between the fore and aft sections.

U.S. Pat. No. 2,983,308 discloses a folding picnic table and benches having a segmented pivotally connected frame supporting a bench at either end thereof. A leg is pivotally connected to each end of the frame. A table is pivotally connected to the mid point of the frame.

U.S. Pat. No. 3,154,345 discloses a chair including a frame having a seat portion and a backrest portion. A buoyant seat cushion is detachably supported by the frame.

U.S. Pat. No. 3,160,437 discloses a seating device including a table having a top. A chair having a folding back is carried by a sliding bar affixed to the underside of the table.

U.S. Pat. No. 3,363,361 discloses a constructional toy composed of separable rods and plates. Also provided are connecting pieces having tubular ends for receiving spigots carried by the rods. Interlocking male and female components project from one face of each plate.

It is apparent from the foregoing references that the prior art has substantially neglected the provision of furniture which is useable either upon a swimming pool deck or within the water. It would be highly advantageous therefore to remedy the immediate inherent deficiency of the prior art.

Accordingly, it is an object of the present invention to provide furniture especially adapted for use in connection with swimming pools and similar environments.

Another object of the invention is the provision of amphibious furniture useable upon patios and decks and in water.

And another object of the invention is to provide furniture in a kit form.

Still another object of this invention is the provision of furniture which is erectable in various configurations.

Yet another object of the invention is to provide amphibious furniture especially including table and chairs.

A further object of the instant invention is the provision of an amphibious furniture kit in which a table is buoyantly supported by a chair.

And a further object of the invention is to provide a kit in which a selective number of chairs are detachably connectable to a table.

Still a further object of the invention is the provision of furniture which is sufficiently light in weight to be readily movable.

And still a further object of the invention is to provide furniture in kit form which is assemblable and disassemblable without tools or special skills.

Yet still a further object of the invention is the provision of furniture of the above type which is relatively inexpensive to manufacture yet is comparatively strong and durable.

Briefly, to achieve the desired objects of the instant invention in accordance with a preferred embodiment thereof, provided is a table and a chair. Engagement means are also provided for detachably connecting the table to the chair. Flotation means, carried by the chair, buoyantly support the table and the chair. The chair further includes removable legs.

In accordance with a more specific embodiment of the invention, the chair includes a frame having a pair of spaced apart generally horizontal elongate side members. The side members are connected at the respective rearward ends by a lateral brace. Elements of the flotation means encircle side members and the lateral brace. A seat, preferrably fabricated of flexible material, extends between the side members of the frame. The table, which does not include legs, carries an element of a male-female connection pair which is detachably securable to a complemental element of the male-female connection pair carried by the chair.

The further and foregoing and more specific objects and advantages of the instant invention will become readily apparent to those skilled in the art from the following detailed description of preferred embodiments thereof taken in conjunction with the drawings, in which.

Figure 1:
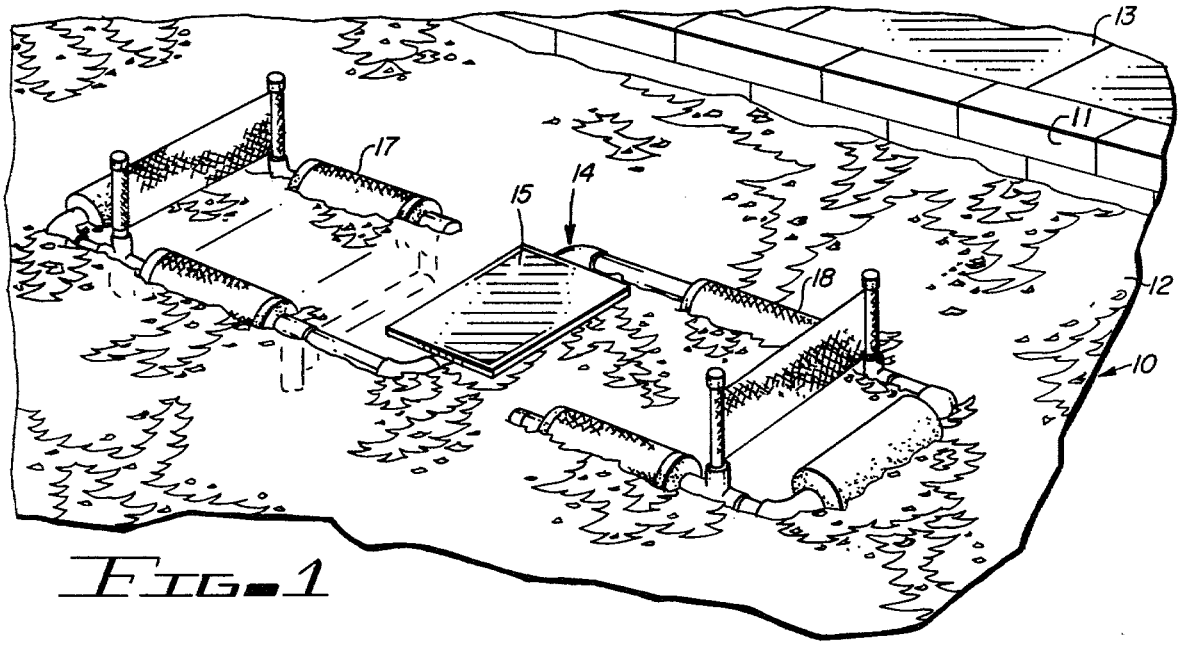
FIG. 1 is a perspective view of amphibious furniture, including table and chairs constructed in accordance with the teachings of the instant invention, as it would appear in use in connection with a conventional swimming pool, the pool being shown in partial perspective.

Turning now to the drawings in which like reference numerals indicate corresponding elements throughout the several views, attention is first directed to FIG. 1 which shows a conventional swimming pool generally designated by the reference character 10 including continuous side wall 11 forming a receptacle for the body of water 12 and deck 13. Floating upon water 12 is a furniture structure erected from the kit of the instant invention and including table 15 and chairs 17 and 18. Chairs 17 and 18 are identical, the description of one being applicable to the other. Further, additional chairs may be used in combination with a single table as will become apparent during the following description.

Figure 5:
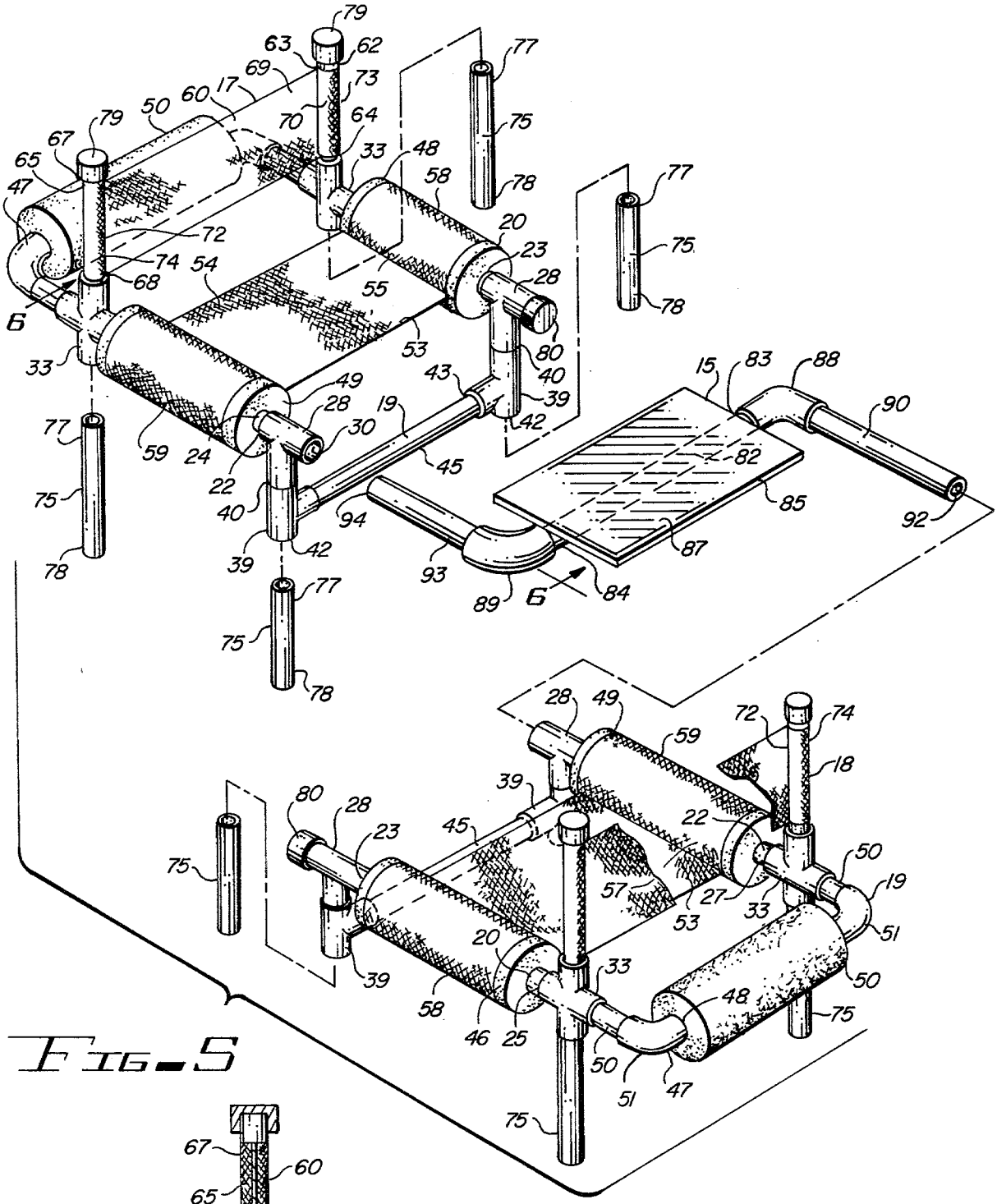
FIG. 5 is an enlarged exploded perspective view of the amphibious furniture of FIG. 1.

With further reference to FIG. 5, it is seen that each chair 17 and 18 includes a frame 19 which is preferrably fabricated of a commercially available tubular material such as polyvinyl chloride (PVC) pipe. The use of other materials, including aluminium tube and wooden rod, will readily occur to those skilled in the art. Extending along either side of frame 19 are elongate side members 20 and 22 having forward ends 23 and 24, respectively, and rearward ends 25 and 27, respectively. The side members 20 and 22, being in spaced apart parallel relationship, and generally horizontal and substantially lie in a plane.

Figure 6:
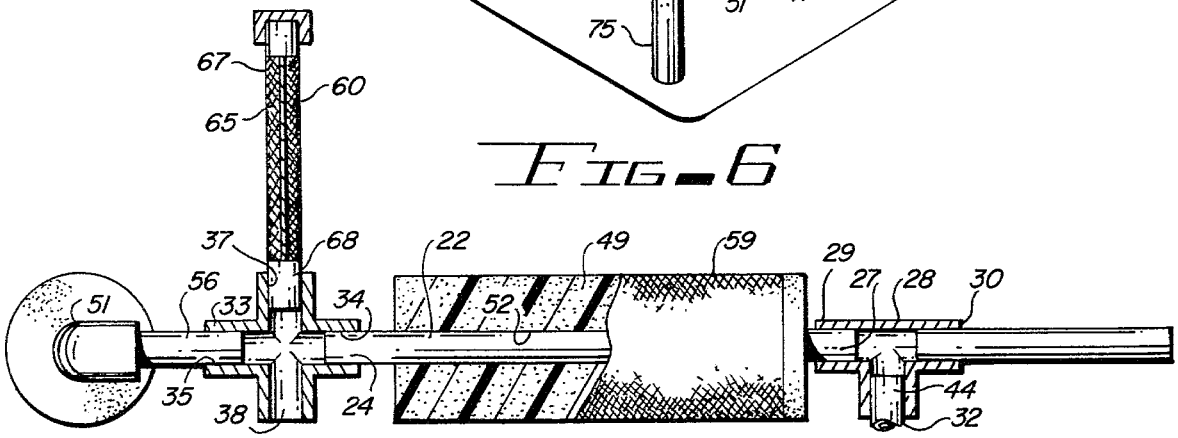
FIG. 6 is an enlarged partial vertical sectional view taken along the line 6—6 of FIG. 5.

A T coupling 28 is secured to each forward end 23 and 24 of side members 20 and 22, respectively. Each T coupling 28, as illustrated in FIG. 6, includes forwardly directed and rearwardly directed horizontal sockets 29 and 30, respectively, and downwardly directed socket 32. The horizontal rearwardly directed socket receives the forward end of the respective side member.

A four way or cross coupling 33 is carried at the rearward end of each side member 20 and 22. Cross coupling 33 includes forwardly and rearwardly directed horizontal sockets 34 and 35, respectively and upwardly and downwardly directed vertical sockets 37 and 38, respectively. The rearward ends 25 and 27 of side members 20 and 22, respectively, are received within respective sockets 34.

A second T coupling 39 is positioned immediately below each T coupling 28. Each T coupling 39 includes upwardly and downwardly directed vertical sockets 40 and 42, respectively, and inwardly directed horizontal socket 43. A nipple 44 is concurrently received within sockets 32 and 40 to secure second T coupling 39 to first T coupling 28. The ends of a lateral brace member 45 are received within sockets 43 of T couplings 39 to maintain side members 20 and 22 in spaced relationship.

A rearwardly positioned generally U-shaped brace member 47 further maintains the side members 20 and 22 in spaced relationship and substantially lies in the plane determined by side members 20, 22. In the immediate embodiment, U-shaped brace member 47 includes an intermediate straight section 46 having an elbow 51 at either end thereof. Nipples 56 held by elbows 51 are engaged within sockets 35 of the respective cross couplings 33. It will be appreciated that U-shaped brace member 47 may be fabricated of a single element which is bent to provide two forwardly extending projections.

Flotation means for chairs 17 and 18 is in the form of first, second and third elements 48, 49 and 50. Preferably, each flotation means is a generally cylindrical structure fabricated of an appropriate foamed material, such as the polystyrene sold under the trademark Styrofoam. Second element 49, as specifically illustrated in FIG. 6, has an axial bore 52 which receives side member 22 therethrough. Accordingly, element 49 encases an intermediate portion of side member 22. Similarly, first element 48 encases an intermediate portion of side member 20 and third element 50 encases a portion of U-shaped brace member 47.

Seat element 53 extending between side members 20 and 22 includes a generally horizontal panel 54 having first and second lateral edges 55 and 57. A first loop 58 carried at first lateral edge 55 encircles first flotation element 48. Similarly, a second loop 59 carried at second lateral edge 57 encircles second flotation element 49. Preferably, seat element 53 is integrally fabricated of canvas or other suitable flexible material, the loops being formed by sewing along lateral edges 55 and 57.

Backrest element 60 includes first upright support member 62 having upper and lower ends 63 and 64, respectively, and second upright support element 65 having upper and lower ends 67 and 68, respectively. Lower end 64 is received within the upwardly directed vertical socket of one cross coupling 33 while the lower end 68 of the other support element 65 is received within the upwardly directed vertical socket 37 of the other cross coupling 33. Extending between support elements 62 and 65, in general analogy to seat element 53, is a flexible panel 69 having first and second lateral edges 70 and 72. First loop 73 integral with first lateral edge 70 encircles first support 62. Similarly, second loop 74 integral with second lateral edge 72 encircles second upright support element 65.

A plurality of legs 75, each having an upper end 77 and a lower end 78, are detachably securable to frame 19. The upper end 77 of two of the legs 75 are receivable within the downwardly directed sockets 32 of the T couplings 28. The upper ends 77 of the two additional legs 75 are receivable within the downwardly directed vertical socket of each cross coupling 33. Primarily for appearance, a cap 79 is engaged with the upper ends 63 and 67 of upright support element 62 and 65. For the same purposes, a plug 80 is inserted into one of the forwardly directed sockets 30.

Table 15 includes a frame in the form of elongate tubular element 82 having first and second ends 83 and 84. A top 85 having substantially a horizontal upper surface 87 is carried by element 82 intermediate ends 83 and 84. First and second elbows 88 and 89 are secured to the first and second ends 83 and 84, respectively, of tubular element 82. First horizontal tubular element 90 having free end 92 and second horizontal tubular element 93 having free end 94 project from first and second elbows 88 and 89, respectively. The free ends 92 and 94 are detachably received within respective forwardly directed sockets 30 for detachably connecting table 15 to chairs 17 and 18.

Figure 2:
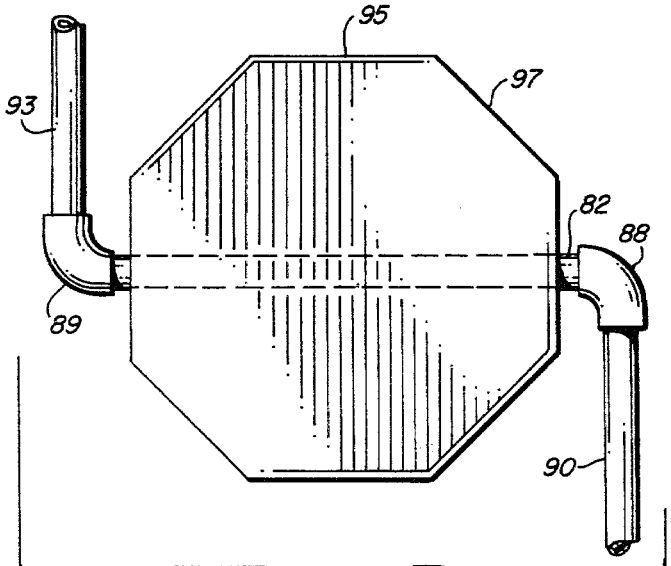
FIG. 2 is an enlarged top plan view of an alternate table useable in connection with the apparatus of FIG. 1.

The top 85 of table 15, as illustrated in FIGS. 1 and 5, is generally rectangular. In order to gain access to a chair, a person must pass between a corner of the table and the respective plug 80. The distance between plug 80 and the table is limited by the size of the top and the length of horizontal tubular elements 90 and 93. FIG. 2 illustrates an alternate table 95 having a generally octangular top 97. The octangular configuration provides for a larger top without increasing the length of the horizontal tubular elements since the person may pass his body between the angled side of top 97 and plug 80.

Figure 4:
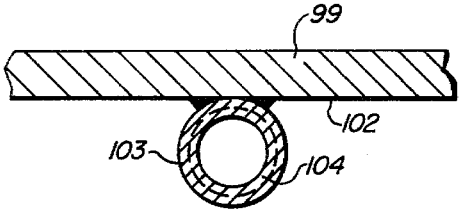
FIG. 4 is an enlarged vertical sectional view taken along the line 4—4 of FIG. 3.
Figure 3:
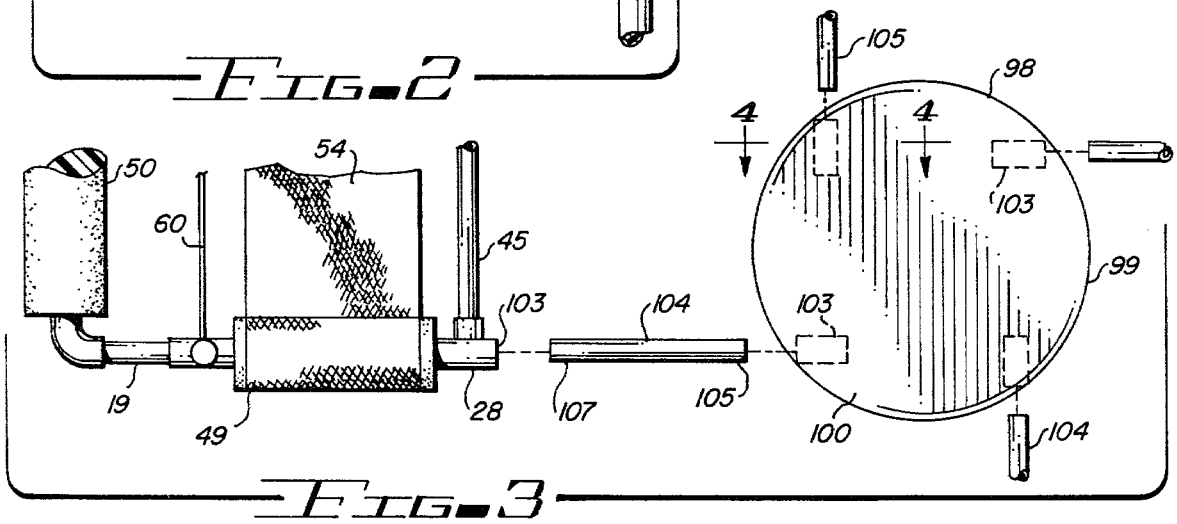
FIG. 3 is an enlarged fragmentary plan view of the apparatus of FIG. 1 and showing yet another embodiment of a table useful in connection therewith.

FIG. 3 illustrates yet another alternate embodiment of a table generally designated by the reference character 98 especially adapted for concurrent connection to four chairs of the type previously described. Table 98 includes top 99 having upper surface 100. Secured to the under side 102 of top 99, as further illustrated in FIG. 4, are four equiangularly spaced receptacles 103. Each receptacle 103 is directed outwardly from top 99 and is oriented at 90° from each adjacent receptacle. A horizontal tubular element, generally similar to previously described horizontal tubular elements 90 and 93, is associated with each receptacle 103. Each element 104 includes a first end 105 engagable within a respective receptacle 103 and a second end 107 detachably connectable with sockets 103 of the respective chairs. Horizontal tubular elements 104 and sockets 103 are considered to be the frame portion of table 98.

The instant invention is a kit for amphibious furniture which may be erected in various configurations. The chairs are used independently or optionally joined with a table. With legs attached, the chairs are usable upon the deck of the swimming pool. The legs are readily disconnected, however, for use in the water. The flotation means are capable of simultaneously supporting the several chairs, the table and the occupants of the chairs. Accordingly, the structure provides the advantage that two or more persons, while floating in a swimming pool, may utilize the table for the playing of various games or supporting various objects such as drink glasses and ashtrays. For this purpose, the device is fabricated of relatively lightweight corrosion resistant material of various types as will readily occur to those skilled in the art.

A feature of the invention is the provision of amphibious furniture in kit form. The device may be manufactured, packaged, shipped and sold as disconnected elements along with a set of instructions for erection by the user. The various connections may be bonded by use of a suitable adhesive at the option of the user. Certain connections, such as between the legs and the frame of the chair and between the chair and the table, are not intended to be permanently affixed but rather detachably connected when desired by the user.

It is within the scope of the invention that the legs and the table are readily, quickly and conveniently attached to or detached from the chair without use of tools or special skills. To accomplish this objective, each connection is of the male-female engagement pair type. That is, the several sockets are considered to be one element of the male-female connection pair while the respective ends of the legs or the horizontal tubular elements are considered to be the complemental elements of the male-female connection pair.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described and disclosed the present invention, and alternately preferred embodiments thereof, in such clear and concise terms as to enable those skilled in the art to understand and practice the same, the invention claimed is:

1. A kit for the erection of amphibious furniture comprising:

a plurality of chairs, each of said chairs having a frame having a pair of sides held in spaced substantially parallel relationship and substantially defining a plane;

a brace connecting said sides and substantially lying in the plane determined by the sides;

a plurality of legs;

means for removably securing said legs to said frame, said legs when secured to said frame supporting said sides and brace a predetermined distance above a solid surface;

flotation elements substantially uniformly surrounding each of the sides and the brace;

a table having a table frame;

a top surface connected to said table frame; and means for removably securing said chairs to said table, said chairs supporting said table so that said table is substantially parallel to the plane of the sides of said chairs, said chairs adapted to float in water, to support a person sitting in each chair, and to support said table connected to said chairs.

2. A kit as defined in claim 1 in which the number of chairs is two and the brace of each chair is U-shaped.

3. A kit as defined in claim 1 in which each of the flotation elements is cylindrical and is provided with an axial bore through which a side or the brace extends.

4. The kit of claim 1 in which the number of legs of each chair is four.

5. The kit of claim 1 in which the table is removably connected to only one of the sides of each chair.

6. An amphibious chair comprising:

a frame having a pair of side members in spaced substantially parallel relationship to each other and substantially defining a plane;

a U-shaped brace member connecting said side members, said brace member substantially lying in said plane;

a pair of support members extending upwardly from the junction of the brace member and the side members;

leg means removably secured to said frame for supporting said frame a predetermined distance above a substantially solid planar surface;

flotation elements encasing each of the side members and the brace member, each of said flotation elements being cylindrical and having an axial bore for receiving a side member or the brace member;

a seat element extending between said side members, said seat element being provided with a pair of loops which encircle the flotation elements encasing each of said side members; and a back rest element extending between said support members; whereby said chair can float in a body of water and support the weight of a person sitting in said chair.

* * * * *